US007082701B2

(12) United States Patent
Dalgaard et al.

(10) Patent No.: US 7,082,701 B2
(45) Date of Patent: Aug. 1, 2006

(54) FOOTWEAR VARIABLE TENSION LACING SYSTEMS

(75) Inventors: Martin Dalgaard, Topanga, CA (US); Andrew Bjornson, Bedford, MA (US); Steven Richard Burke, Huntington Beach, CA (US); Jacob Hall, Midway, UT (US); Jared Bevens, Hermosa Beach, CA (US); Jeffrey Grella, Newport Beach, CA (US)

(73) Assignee: Vans, Inc., Santa Fe Springs, CA (US)

( * ) Notice: Subject to any disclaimer, the term of this patent is extended or adjusted under 35 U.S.C. 154(b) by 0 days.

(21) Appl. No.: 10/764,297

(22) Filed: Jan. 23, 2004

(65) Prior Publication Data

US 2005/0160627 A1 Jul. 28, 2005

(51) Int. Cl.
*A43C 11/14* (2006.01)

(52) U.S. Cl. ..... 36/50.1; 36/50.5

(58) Field of Classification Search ..... 36/50.1, 36/50.5

See application file for complete search history.

(56) References Cited

U.S. PATENT DOCUMENTS

| | | | | |
|---|---|---|---|---|
| 3,657,827 | A | 4/1972 | Rieker | 36/50 |
| 3,808,644 | A * | 5/1974 | Schoch | 24/68 SK |
| 3,834,048 | A * | 9/1974 | Maurer | 36/50.1 |
| 5,157,813 | A * | 10/1992 | Carroll | 24/68 SK |
| 5,177,882 | A | 1/1993 | Berger | 36/50.1 |
| 5,325,613 | A * | 7/1994 | Sussmann | 36/50.1 |
| 5,535,531 | A | 7/1996 | Karabed et al. | 36/50.1 |
| 5,537,763 | A * | 7/1996 | Donnadieu et al. | 36/50.1 |
| 5,755,044 | A | 5/1998 | Veylupek | 36/501 |
| 5,940,990 | A | 8/1999 | Barret | 36/55 |
| 6,202,953 | B1 | 3/2001 | Hammerslag | 242/396.1 |
| 6,289,558 | B1 | 9/2001 | Hammerslag | 24/68 |
| 6,327,750 | B1 | 12/2001 | Muldowney et al. | 24/68 |
| 6,339,867 | B1 | 1/2002 | Azam | 24/712.5 |
| 6,378,230 | B1 | 4/2002 | Rotem et al. | 36/50.1 |
| 6,467,195 | B1 | 10/2002 | Pierre et al. | 36/50.5 |
| 6,775,928 | B1 | 8/2004 | Grande | 36/50.1 |
| 2001/0007178 | A1 | 7/2001 | Pierre et al. | 36/50.5 |
| 2002/0020046 | A1 | 2/2002 | Voughlohn | 24/712.1 |
| 2002/0083619 | A1 | 7/2002 | Durocher | 36/50.1 |
| 2002/0083621 | A1 | 7/2002 | Durocher | 36/50.5 |
| 2002/0092142 | A1 | 7/2002 | Schoen | 24/712.1 |
| 2002/0095750 | A1 | 7/2002 | Hammerslag | 24/68 |
| 2002/0100150 | A1 | 8/2002 | Gioffre | 24/712 |
| 2002/0194712 | A1 | 12/2002 | Jackson et al. | 24/300 |
| 2002/0194748 | A1 | 12/2002 | Jackson et al. | 36/51 |
| 2003/0009917 | A1 | 1/2003 | Voswinkel | 36/50.1 |

(Continued)

*Primary Examiner*—Marie Patterson
(74) *Attorney, Agent, or Firm*—Winston & Strawn LLP

(57) ABSTRACT

Variable tension footwear lacing systems and methods permit and facilitate adjustment of selected zones by a user. In an embodiment, stop devices are used with a footwear lacing system to prevent opposing closure edges of a footwear article from advancing towards each other. The stop device includes a stop guide configured for fastening to a portion of the footwear article, and a stop element. In an implementation, the stop element includes a stop head and a releasable affixing member. The stop head is configured to be manipulated by a user to releasably secure the affixing member to a selected position across the length of the stop guide. The stop head is operable to contact a first closure edge of the footwear article. In an embodiment, during use first and second stop devices contact first and second opposing closure edges of the footwear article and prevent them from advancing towards each other.

14 Claims, 13 Drawing Sheets

U.S. PATENT DOCUMENTS

2003/0034365 A1 2/2003 Azam et al. ..... 223/113
2003/0041476 A1 3/2003 Liu ..... 36/50.1
2003/0041477 A1 3/2003 Liu ..... 36/50.1
2003/0041478 A1 3/2003 Liu ..... 36/50.1
2003/0051374 A1 3/2003 Freed ..... 36/50.1
2003/0177662 A1 9/2003 Elkington et al. ..... 36/50.1

* cited by examiner

FOOTWEAR VARIABLE TENSION LACING SYSTEMS

BACKGROUND ART

The invention generally pertains to variable tension lacing systems for footwear. More particularly, the tension systems permit adjustment of selected zones of the footwear lacing system, to provide an improved fit and to prevent discomfort during use.

There are numerous systems that currently exist for tightening footwear about the foot of a wearer. The most common includes threading a lace in a zig-zag pattern through two parallel rows of eyelets that are placed on opposite sides of a tongue area of a shoe or boot. The shoe is tightened by pulling on opposite ends of the threaded lace to pull the two rows of eyelets together so that the closure edges of the cuffs are urged toward the middle of the foot, and then tying the lace ends in a knot to maintain the desired tension. There are a number of known problems with such traditional systems, including that the tightening force is not adequately distributed along the length of the threaded zone due to friction between the laces and eyelets. Thus, some portions of the lace may be slack while other portions are taut which results in certain portions of the shoe being tighter around certain sections of the foot, particularly the ankle portions which are closer to the lace ends. This can cause discomfort and may adversely affect performance when the wearer is involved in a sports activity.

Conventional lacing systems are also typically difficult to untighten and/or difficult to readjust in order to redistribute tension because the wearer must loosen and adjust the lace from each of many eyelets. Simply untying the knot does not release the lace because friction between the lace and eyelets and between overlapping laces often maintains the toe portion and sometimes even much of the other areas above the foot in tension even after the knot is released. Consequently, a wearer often must loosen the lace from each individual eyelet, which can be tedious if the number of eyelets is high, for example, such as in an ice skate boot, a snowboard boot, or other high-performance sports footwear.

Certain sports footwear, such as ski boots use tightening mechanisms that include buckles that clamp together to tighten the boot about the foot. Such systems typically use three or four buckles positioned about the tongue area of the boot, and can be quickly clamped to tighten and unclamped to loosen the boot about the foot. However, such systems isolate the closure forces about the immediate area of the buckle which can be undesirable in many circumstances, such as when the wearer is engaged in a sport that requires an evenly distributed force line along the length of the foot. In addition, buckles tend to be uncomfortable if used on some types of footwear, such as soft boots, and thus are primarily used only on hard-shell type footwear such as ski boots.

Other footwear lacing systems have been developed that include a lace or cable attached to a tightening mechanism. In one such system, the lace is threaded through a series of opposing guide members positioned along the top of the foot and ankle portions of the footwear. The tightening mechanism operates to wind up the lace to tighten the shoe about the foot, and to wind out the lace to release tension. The lace and guide members have low friction surfaces to facilitate sliding of the lace through the guide members to promote the even distribution of tension across the footwear. However such systems cannot be used to isolate any specific region where a user may wish to increase or decrease tension.

Further, as a wearer performs certain maneuvers, some sections of the system become constricted due to stress forces which causes discomfort. For example, snowboard riders wearing boots that include such a system have complained that the lace, which is typically a cable, tightens and causes discomfort across a lower portion of the tongue during flexion. A need thus exists for a tension lacing system that can be adjusted by a user to avoid discomfort that may occur when a shift in tension forces occurs during use.

SUMMARY OF THE INVENTION

In a first embodiment, presented is a stop device for use with a footwear lacing system for preventing opposing closure edges of a footwear article from advancing towards each other. The stop device includes a stop guide configured for fastening to a portion of the footwear article, and a stop element having a stop head and a releasable affixing member. The stop head is configured to be manipulated by a user to releasably secure the affixing member to a selected position across the length of the stop guide, and the stop head is operable to contact a first closure edge of the footwear article.

In an advantageous implementation, a first distal end of the stop guide is configured for attachment to a tongue of the footwear article. The second distal end of the stop guide may be free-floating. In addition, a cross guide member may be included that is configured for attachment to the tongue. The cross guide member may include a base section with a sleeve to accommodate the second distal end of the stop guide, and a guide portion including at least one channel for guiding the lace.

In a beneficial variation, the stop device may include a stop guide with a plurality of openings, and the affixing member may include at least one stop pin for releasably mating with a selected opening. The affixing member could include at least two stop pins, and the stop element may include a stop tab.

In a preferred embodiment, a stop system includes a second stop device that includes a second stop guide and a second stop element having a second stop head, and a second releasable affixing member, wherein the second stop device is fastened to a portion of the footwear article that is adjacent to and opposite a first stop device such that the second stop head is operable to contact a second closure edge of the footwear article. In addition, the stop head may have a front surface that is shaped to complement the shape of a cable guide member, wherein the cable guide member is associated with the closure edge of the footwear article and guides the lace.

In a variation, the stop guide includes a plurality of teeth and the affixing member includes at least one tooth. In addition, the implementation may include a second stop element having a second affixing member that includes at least one tooth for releasably meshing with the teeth of the stop guide. In this case, first and the second stop elements include first and second stop heads configured to contact the first closure edge and an opposing second closure edge of the footwear article. The stop heads may be stop hooks that are shaped to securely contact the closure edges of the footwear article.

Another implementation of a stop device for use with a footwear lacing system includes a stop head having a first surface operable to contact a first closure edge of the footwear article, a tab connected to the stop head, and a fastener for releasably securing the tab in a selected position on the tongue area. The tab includes at least one adjustment hole for attachment to a tongue area of the footwear article.

In an advantageous implementation, included is a second stop device comprising a second stop head having a surface operable to contact a second closure edge of the footwear article, a second tab connected to the second stop head and a second fastener for releasably securing the second tab in a selected position that is adjacent to and opposite a first stop device such that the second stop head is operable to contact the second closure edge of the footwear article. The second tab includes at least one adjustment hole for attachment to a tongue area of the footwear article. The front surface of the stop head may be shaped to complement the shape of a cable guide member that is associated with the closure edge of the footwear article.

Another stop device for use with a footwear lacing system according to the invention includes a stop head having first and second opposing surfaces and a fastener assembly for releasably securing the stop head in a selected location on a tongue area of the footwear article. In this implementation, the stop head includes an offset attachment point for the fastener assembly and is rotatable about the attachment point such that either the first surface or the second surface may be chosen to contact a first closure edge of the footwear article.

In an advantageous embodiment a second stop device is provided that includes a second stop head having first and second opposing surfaces and a second fastener for releasably securing the stop head in a selected location that is adjacent to and opposite a first stop device. The second stop head includes an offset attachment point for the fastener assembly and is rotatable about the attachment point such that either the first surface or the second surface of the second stop head may be chosen to contact a second closure edge of the footwear article. The first and second opposing surfaces of the stop head may be shaped to compliment the shape of a cable guide member that is associated with the closure edge of the footwear article.

Another aspect according to the invention concerns a stop device for use with a footwear lacing system that includes a housing having at least one lace channel for permitting a lace to freely pass therethrough, at least one adjustable stop bumper, and at least one tightening mechanism. The stop bumper is located on at least a first distal end of the housing, and includes a lace channel therethrough and a contact edge for contacting a closure edge of the footwear article. The tightening mechanism is connected to the housing and is associated with the stop bumper and used to adjust the length between an edge of the distal end of the housing and the contact edge.

In an advantageous embodiment, the tightening mechanism includes a twist tightening mechanism and a threaded tube. In addition, the housing may be cross-shaped and include two crossing lace channels and at least two adjustable stop bumpers, the stop bumpers configured to contact first and a second opposing closure edges of the footwear article. In addition, a tightening mechanism may be associated with each of the stop bumpers. In a variation, four adjustable stop bumpers are provided, the stop bumpers configured to contact first and a second opposing closure edges of the footwear article.

Yet another aspect of the invention concerns a fooled ear lacing system for an article of footwear that includes a tongue area having first and second opposing side edges. The system includes a plurality of lace guide members affixed to the first and second side edges and positioned in opposing relationship to each other for guiding the lace to traverse the tongue area. Also included is at least one lace guided by the guide members to traverse the tongue area, and at least one adjustable stop device configured to contact a lace guide when the lace is tensioned. The stop device prevents the first side edge from approaching the second side edge when the lace is tensioned.

In an advantageous implementation, the footwear lacing system includes a tightening mechanism connected to the footwear article, wherein the lace is rotationally connected to the tightening mechanism. In addition, each stop device may include a stop guide and at least one adjustable stop element the at least one stop element having a stop head and a releasable affixing member. The stop head may be beneficially configured to be manipulated by a user to releasably secure the affixing member to a selected position across the length of the stop guide, and the stop head is operable to contact a lace guide member. In addition, the stop head may have a front surface that is shaped to complement the shape of a cable guide member. A preferred embodiment includes a second stop device that includes a second stop guide and a second stop element having a second stop head and a second releasable affixing member. This second stop device could be fastened to a portion of the footwear article that is adjacent to the original stop device such that the second stop head is operable to contact an opposing lace guide member. In a variation, a second stop element has an affixing member that includes at least one tooth for releasably meshing with the teeth of the stop guide. In this case, a first stop element and the second stop element include first and second stop heads configured to contact first and second opposing lace guides.

In an advantageous embodiment, the stop device includes a stop head having a contact surface for contacting a lace guide member, a tab connected to the stop head, and a fastener for releasably securing the tab in a selected position on the tongue area. The tab includes a plurality of adjustment holes for attachment to the tongue area. In a variation, the stop device includes a stop head having first and second opposing surfaces, and a fastener assembly for releasably securing the stop head in a selected location on the tongue area, wherein the stop head includes an offset attachment point for the fastener assembly and is rotatable about the attachment point such that either the first surface or the second surface may be chosen to contact a lace guide member.

Yet another aspect of the invention concerns a footwear lacing system for an article of footwear that includes a tongue area and first and second opposing closure edges. The system also includes at least one lace, a lace guiding system having a plurality of lace guides affixed to the first and second closure edges for guiding the lace to traverse the tongue area in a plurality of locations to enable tightening of the footwear on the foot of a wearer, and at least one lace end tightening device affixed to the footwear for accommodating an end portion of the lace to provide for adjustments to the tension of the lace.

In a desirable implementation, the system includes a tightening mechanism affixed to the footwear and connected to the lace, the tightening mechanism is operable by a user to tension the lace. In addition, the lace end tightening device may be a cable-end tightener that comprises an end section affixed to the footwear, and a twist tightening mechanism associated with the end section. In a variation, the lace end tightening device may be a cable length adjustment device affixed to the footwear, Wherein the adjustment device includes a plurality of end stations each capable of releasable connection to the lace. The cable length adjustment device may also include a serpentine path for accommodating the lace.

Another aspect of the invention concerns a method for stabilizing at least one zone of a lace tensioning system of a footwear article. The technique includes adjusting a stop system affixed to a tongue area, wherein the stop system includes components capable of contacting first and second closure edges in at least a first zone of the footwear article, and tensioning the lace in the at least first zone such that the components of the stop system prevent the first and second closure edges from advancing towards each other.

In an advantageous implementation, the stop system is adjusted by manipulating at least one stop head that is releasably affixed to a stop guide. In a variation, the method further includes adjusting the stop system by manipulating at least one stop hook that is releasably affixed to a toothed track. Yet another variation includes adjusting the stop system by manipulating at least one twist tightening mechanism of a cable lock-out device. In a preferred embodiment, the method further includes adjusting a second stop system affixed to a tongue area, wherein the second stop system includes components capable of contacting first and second closure edges in at least a second zone of the footwear article.

Yet another technique according to the invention concerns a method for stabilizing at least one zone of a lace tensioning system of a footwear article. The method includes adjusting a first adjustable stop device affixed to a tongue in a first zone. The first stop device includes at least one stop element having a stop head and a releasable affixing member, wherein the stop head is configured to be manipulated by a user to be positioned at a selected location on the tongue, and wherein the stop head is operable to contact a first closure edge of the footwear article. The method also includes adjusting a second adjustable stop device affixed to the tongue in the first zone. The second stop device includes at least one second stop element having a second stop head and a second releasable affixing member, wherein the second stop head is configured to be manipulated by a user to be positioned at a selected location on the tongue, and wherein the second stop head is operable to contact a second closure edge of the footwear article. Lastly, the method includes tensioning the lace in the first zone such that the first and second stop devices contact the first and second closure edges and prevent them from approaching each other in the first zone.

In an advantageous embodiment, the method also includes adjusting third and fourth adjustable stop devices in a second zone, and tensioning the lace in the second zone such that the third and fourth stop devices contact the first and second closure edges and prevent them from approaching each other in the second zone.

A variable tensioning system according to the invention can thus advantageously be utilized by a wearer of the footwear to obtain a comfortable and secure fit. Moreover, the variable tensioning components according to the various embodiments of the invention are easy to adjust to obtain a comfortable fit.

BRIEF DESCRIPTION OF THE DRAWINGS

Other aspects, purposes and advantages of the invention will become clear after reading the following detailed description with reference to the attached drawings, in which.

It should be understood that the drawings are not necessarily drawn to scale and that like reference numbers in the various drawings indicate the same or similar components.

DETAILED DESCRIPTION OF THE PREFERRED EMBODIMENTS

Figure 1:
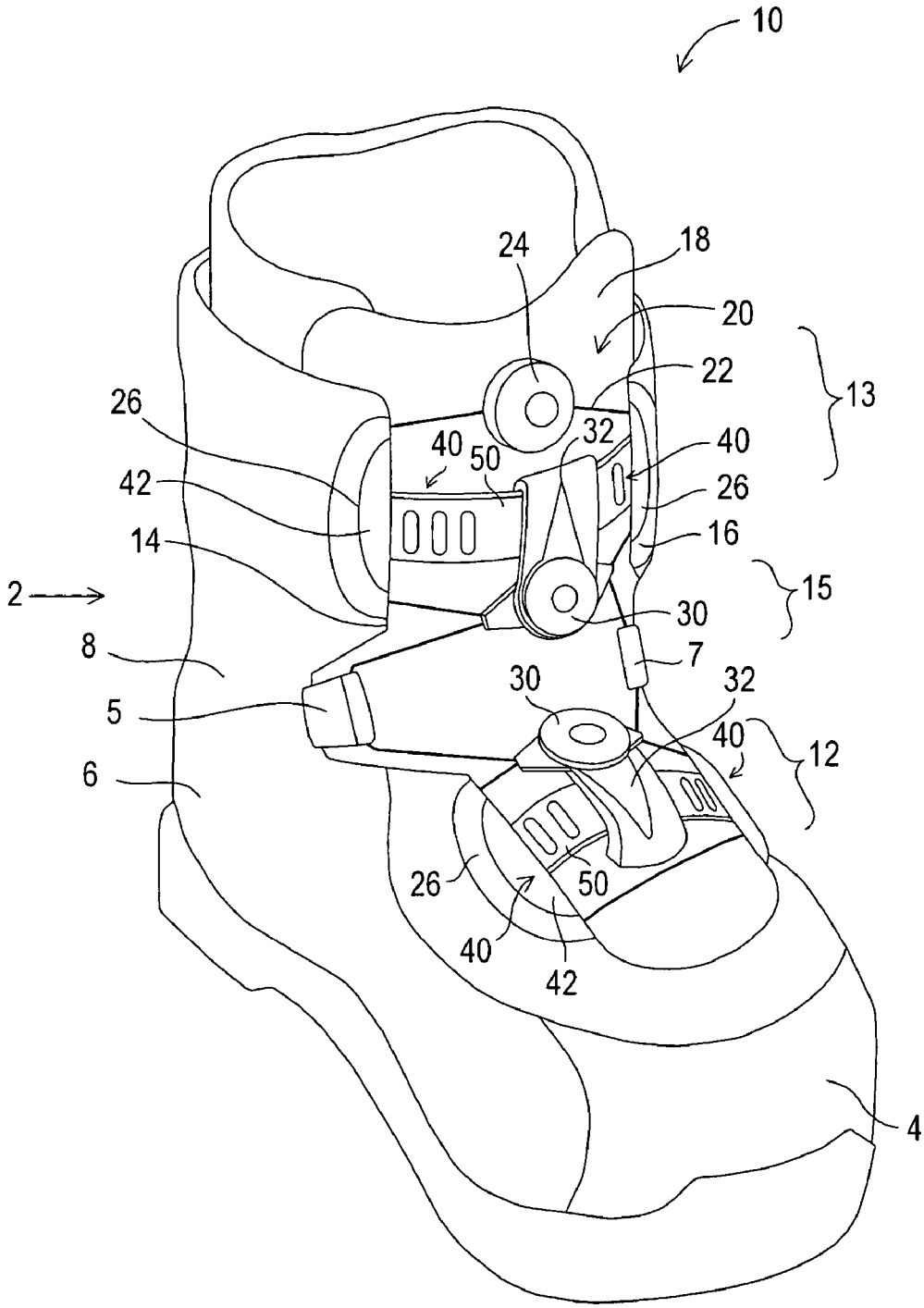
FIG. 1 is a perspective view of a sports boot illustrating a first lacing system according to the invention that includes a first implementation of a stop device.

FIG. 1 is a perspective view of a sports boot 10 illustrating a lacing system 20 that includes a first implementation of a stop device according to the invention. The sport boot 10 generally is a snowboard boot or other sport boot that is tightened about a wearer's foot using the lacing system. Although the present invention will be described herein with reference to a snowboard boot, it should be understood that the invention can be used with a wide variety of footwear.

The boot 10 includes an upper 2 that includes a toe section 4, a heel portion 6, and an ankle portion 8 that surrounds the wearer's ankle. An instep portion 12 of the upper is located in between the toe and ankle areas. The boot upper includes two opposed closure edges 14 and 16 that partially cover a tongue 18. The upper may be manufactured from any of a wide variety of materials known to those skilled in the art. For example, some snowboard boots are typically made of soft leather that conforms to the shape of the foot of a wearer. For other types of shoes or boots, the upper may be manufactured of hard or soft plastic, rubber or of a composite material. Many other types of materials could also be used.

In the implementation of FIG. 1, a lacing system 20 includes a lace or cable 22, a tightening mechanism 24, cable guide members 26, stop devices 40 and lace cross guides 30. It should be understood that, as used herein, the terms lace and cable have the same meaning unless specified otherwise. The cable 22 may be tensioned to draw the closure edges 14 and 16 toward each other, to tighten the boot around the foot.

The tongue 18 extends rearward from the toe section 4, and is preferably made of a soft material such as leather. The tongue may be provided with a low friction top surface to facilitate sliding of the closure edges and laces over the top of the tongue when the lace is tightened or loosened. Such a low friction surface may be applied to the tongue, or may be integral with the tongue.

As shown in FIG. 1, the cable 22 can be threaded in a crossing pattern along the midline of the foot between the two generally parallel closure edges 14 and 16. In this implementation, the cable guide members 26 and the lace cross guides 30 are made of a rigid and durable plastic material. The cable guide members are affixed to the closure edges of the upper in a known manner, such as by stitching rivets, or adhesive. The lace cross guides 30 may also be affixed to the tongue 18 of the shoe. Each of the cable guide members 26 and the lace cross members 30 advantageously include smooth, low-friction channels that guide the cable therethrough. The cable guide members and cross members may be made of materials other than plastic or rubber, such as metal or a polymer or a composite material, and may include a lubricating coating on at least the inner channel surfaces to reduce friction and/or enhance the slideability of the laces passing therethrough. FIG. 1 shows two pairs of opposing cable guide members 26, and two cross members 30 being used. However, other configurations are contemplated that include more or less such members, depending on factors such as the length of the footwear closure edges and the amount of tensioning control desired.

The cable 22 may be one continuous loop that begins and terminates at the tightening mechanism 24, and is threaded through the cable guide members 26 and the cross guide members 30 as discussed above. In addition, the cable 22 may be a low-friction cable that slides easily through the channels in the cable guide members and the cross guides. The cable may be formed of any polymeric or metal materials or a composite material, so long as such material exhibits sufficient axial strength and flexibility. For example, solid core wires, solid core polymers, or multi-filament wires or polymers, which could be woven, braided, twisted or otherwise fabricated could be used. The outer surface of the cable could also be coated with a lubricous material such as Teflon® or nylon. In use on snowboard boots, the cable should be capable of withstanding break loads of at least 60 pounds, and preferably up to 150 pounds or more. The cable varies in length, wherein shorter or longer lengths are used depending on footwear size particular to the lacing system design.

Figure 2A:
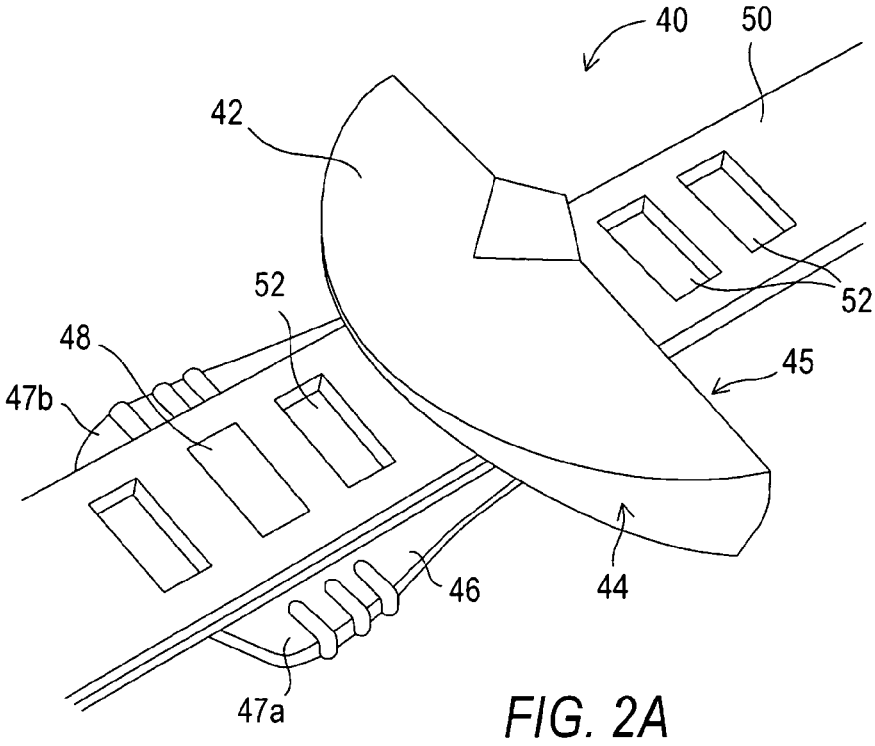
FIG. 2A is an enlarged, perspective view of a stop device according to the invention, for use with a footwear lacing system such as that shown in FIG. 1.

FIG. 2A is an enlarged, perspective view of a stop device 40 for use with a footwear lacing system such as that shown in FIG. 1. The stop device 40 includes a stop head 42 that includes a stop front edge 44, a stop rear edge 45, and a stop base 46. The stop base 46 has at least one associated stop tab 48 and includes ledges or finger surfaces 47A and 47B that allow a user to manipulate the stop tab as explained below. The stop device 40 also includes a stop guide 50 that includes a plurality of openings 52.

Figure 2B:
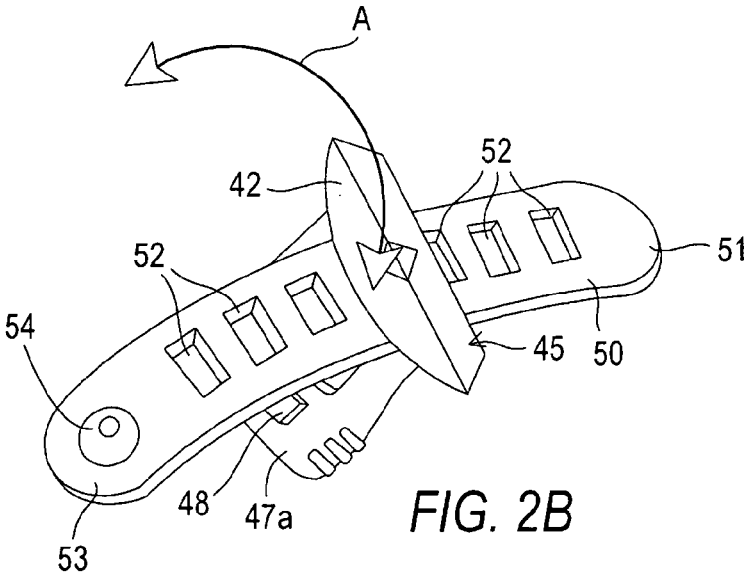
FIGS. 2B and 2C are perspective and side views, respectively, of the stop device of FIG. 2A.
Figure 2C:
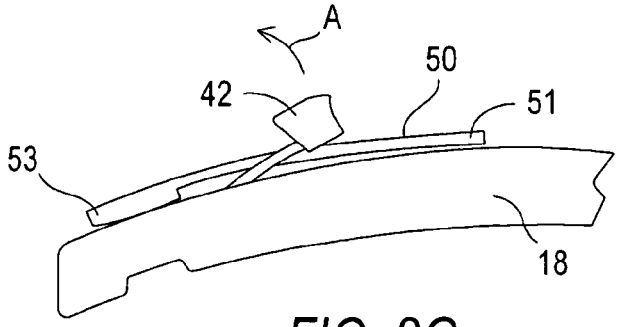

FIGS. 2B and 2C are perspective and side views, respectively, of the stop device 40 of FIG. 2A. The stop guide 50 includes at least one means 54 at a first distal end 53 for fastening the guide to the tongue 18 of an article of footwear. In this implementation, the means for fastening 54 is a rivet, but other fastening devices or fastening methods could be used to secure the first distal end portion 53 of the stop guide to the tongue.

FIGS. 2B and 2C illustrate how the stop head 42 initially pivots in the direction of arrow A when a user disengages the stop tab 48 from an opening 52 of the stop guide 50. The user pushes down on the finger surfaces 47A and 47B with his thumb and forefinger, for example, on either side of the stop guide 50 to pivot the stop head 42 and to urge the stop tab 48 away from the opening 52. Once the stop tab 48 is disengaged from the opening 52, the stop head 42 and stop base 46 can be moved or adjusted by a wearer along the length of the stop guide 50. The stop tab 48 can then be inserted into another of the openings 52 as desired to re-engage and immobilize the stop head 42. It should be understood that more than one stop tab 48 could be associated with the base 46, and that more than one fastening means 54 could be associated with the stop guide 50.

Referring again to FIG. 1 the stop devices are shown in their fitted or stop positions. In the stop positions the front edge 44 of the stop head 42 of each stop device abuts an outside wall of the cable guide members 26 and functions to resist movement of the closure edges 14 and 16 toward each other. FIG. 1 shows two pairs of opposing stop devices 40 (four in all), one pair located in a first zone 13 in the upper cuff portion of the boot, and the other pair located in a second zone or in the instep area 12 in the lower cuff of the boot. The first distal end portions 53 of the various stop guides 50 are affixed to the tongue in locations beneath the eyestay, which in FIG. 1 are beneath the cable guide members 26, and thus are not visible. If the system shown in FIG. 1 is tightened further, the tabs 5 and 7 in a third zone 15 will be urged toward each other. But the eyestay edges of the first zone 13 and second zone 12 will not move due to the stop devices 40.

The cross guides 30 include a base section 32 with a sleeve or underlying open area that covers and accommodates a second distal end portion 51 of the stop guides 50 (see FIGS. 2B and 2C) of two opposing stop devices 40. In this implementation, the base sections 32 cover the second distal ends 51 and form a barrier that limits movement of each stop head 42 in a direction towards the center line of the tongue 18. The base sections 32 thus perform several functions including covering the second distal ends of opposing stop guides and restricting the movement of the stop heads 42. It should be understood that, in this implementation, the second distal ends 51 of the stop guides are free floating under the base section 32, which permits the stop guides and stop heads to articulate to a slight degree when the boot flexes during use. The stop devices 40 are thus able to articulate somewhat about the cable guides members 26 during activity as the boot flexes. This flexibility allows for automatic adjustment as the wearer's foot moves about to change the angle between the upper and lower cuff.

When first putting the boot on the foot, a user may adjust either the first zone 13 about the upper cuff of the lacing system 20, or the second zone 12 about the lower cuff of the lacing system. Users that have a skinny or thin foot adjust the first zone before making other adjustments to ensure that the upper cuff is not too tight. Alternately, wearers that have relatively wide feet and skinny calves initially adjust the second zone to secure the stop devices 40 so that the lower cuff is not too tight. When the entire boot feels comfortable, the user pulls on the finger tabs 47A and 47B (shown in FIGS. 2A to 2C) to engage one or more stop tabs 48 in one or more openings 52 of the stop guide 50 for each stop device 40. The tightening mechanism 24 then can be further manipulated to tighten the third zone 15 adjacent to the instep portion of the boot.

Figure 3A:
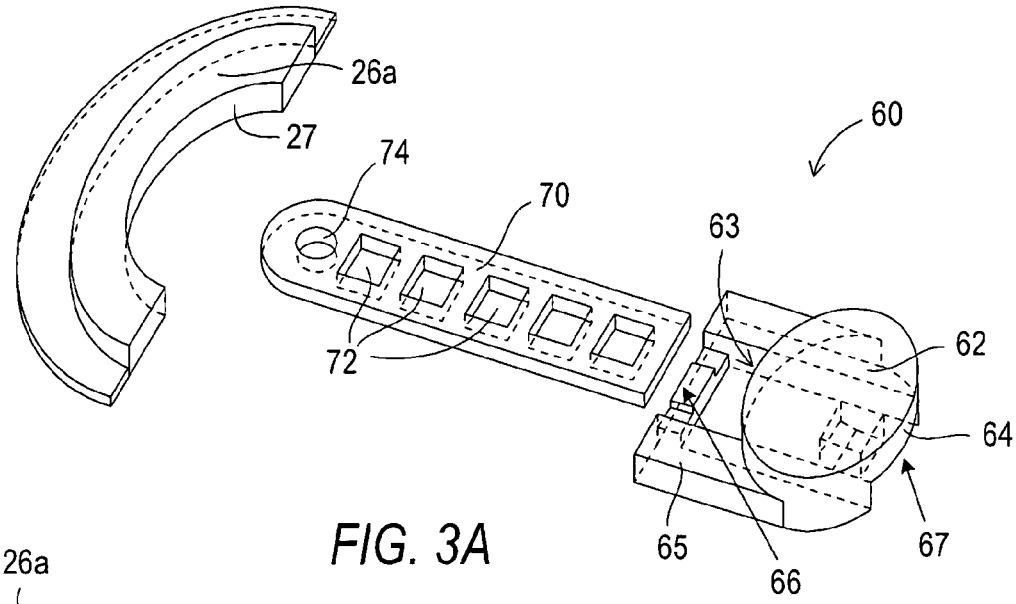
FIGS. 3A to 3C depict another embodiment of a stop device according to the invention.
Figure 3B:
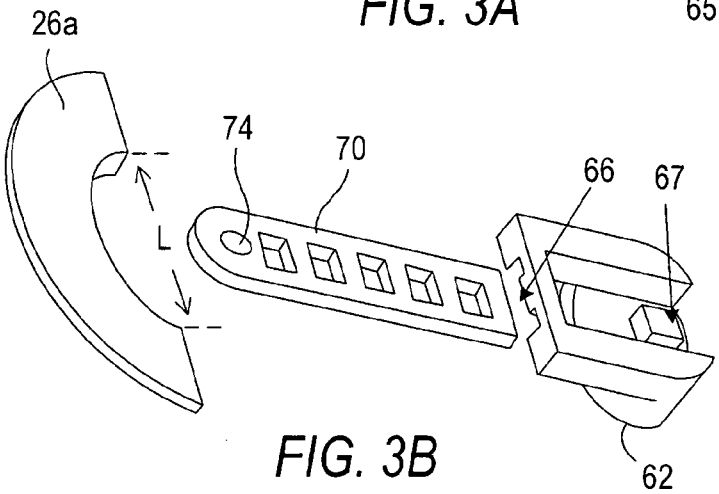
Figure 3C:
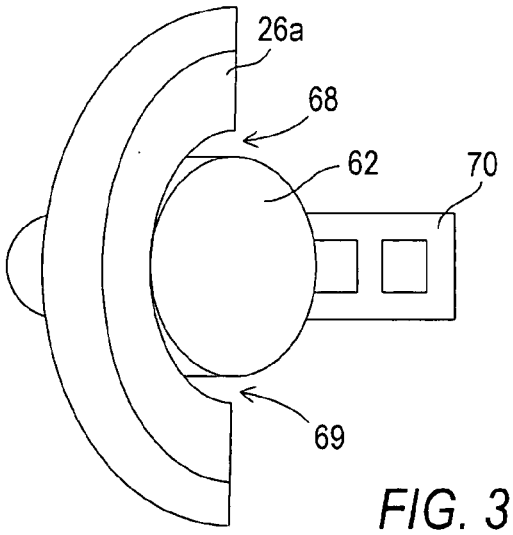

FIGS. 3A to 3C depict another embodiment of a stop device 60. In particular, FIG. 3A is an exploded perspective top view of the stop device 60 and FIG. 3B is a bottom view of FIG. 3A. The stop device 60 includes a stop head 62 having a stop front edge 63, a stop rear edge 64, and a stop base 65. The stop base 65 has two stop tabs 66 and 67. The second stop tab 67 is located beneath the stop head 62. The stop device 60 also includes a stop guide 70 that includes a plurality of stop tab openings 72 and an aperture 74 for accommodating a fastening means, such as a rivet, nut and bolt arrangement, or screw. In use, the stop guide 70 is affixed at the aperture 74 to the tongue of an article of footwear so that it is stationary. The two stop tabs 66 and 67 are configured such that each can mate with a stop guide opening, 72 during use to spread the load forces.

Also shown in FIGS. 3A to 3C is a cable guide member 26*a* that has a semi-circular shape. The front edge 63 of the stop head 62 is generally oval shaped to complement the shape of the inner wall 27, and will loosely fit into the inner wall of the cable guide member 26*a* during use.

Thus, when the stop device 60 is in its stopped position as shown in FIG. 3C, the stop front edge 63 abuts the inner wall 27, but also includes open areas 68 and 69 that allow for some movement as the boot flexes during use. The length L (or diameter) of the inner wall 27 (see FIG. 3B) may be in the range of 0.25 inch to 3 inches. In a snowboard boot application, the length used is about 2 inches, and the length of the front wall of a stop head may be fabricated to be slightly less or to match. Different specific length combinations could be used to optimize the cable system, and one skilled in the art could easily choose a suitable size or length depending upon the type of footwear being used and/or depending on other considerations.

Figure 4A:
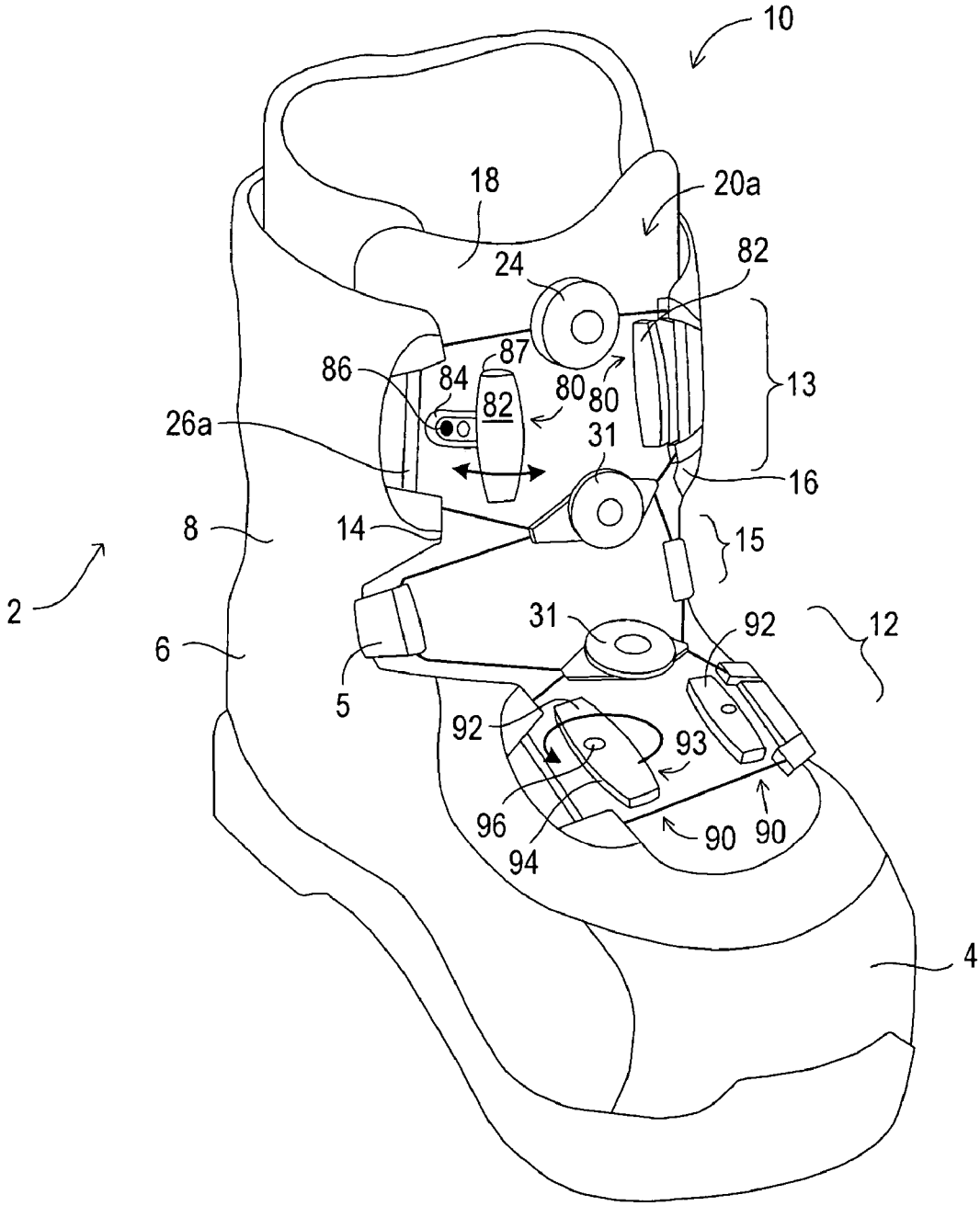
FIG. 4A is a perspective view of a sports boot illustrating a lacing system according to the invention that includes two other implementations of a stop device.

FIG. 4A is a perspective view of a sports boot 10 illustrating a lacing system 20*a* that includes two other implementations of a stop device. The sport boot 10 may be a snowboard boot or other sport boot that is tightened about a wearer's foot by using the lacing system, and elements that are the same or similar to those shown in FIG. 1 are numbered the same in FIG. 4A. Thus, the boot 10 includes an upper 2 that includes a toe section 4, a heel portion 6, and an ankle portion 8 that surrounds the wearer's ankle. An instep portion 12 of the upper is located in between the toe and ankle areas. The boot upper includes two opposed closure edges 14 and 16 that partiality cover a tongue 18. The upper may be manufactured from any of a wide variety of materials known to those skilled in the art. For example, as described above, the boot upper material may be of soft leather that conforms to the shape of the foot of a wearer, or may be manufactured of hard or soft plastic, rubber or of a composite material.

In the implementation of FIG. 4A, the lacing system 20*a* includes a lace or cable 22, a tightening mechanism 24, cable guide members 26*a* that are generally are "C"-shaped, stop devices 80 and 90 and lace cross guides 31. The lace cross guides 31 may be affixed to the tongue 18 of the boot, and the cable 22 may be tensioned to draw the closure edges 14 and 16 toward each other, to tighten the boot around the foot. The tongue 18 extends rearward from the toe section 4, and preferably includes a low friction top surface to facilitate sliding of the closure edges and laces over the top of the tongue when the lace is tightened or loosened.

As shown in FIG. 4A, the cable 22 can be threaded in a crossing or zig-zag pattern along the midline of the foot between the two generally parallel closure edges 14 and 16. The cable guide members 26*a* and the lace cross guides 31 may be made of a rigid and durable plastic material. The cable guide members are affixed to the closure edges of the upper in a known manner, such as by stitching, rivets, or adhesive. Each of the cable glide members 26*a* and the lace cross members 31 advantageously include smooth, low-friction channels that guide the cable therethrough. The cable guide members and cross members may be made of materials other than plastic or rubber, such as metal or a polymer or a composite material, and may include a lubricating coating on at least the inner channel surfaces to reduce friction and/or enhance the slideability of the laces passing therethrough.

Although FIG. 4A shows two pairs of opposing cable guide members 26*a*, and two cross members 31 being used, other configurations are contemplated that include more or less such members, depending on factors such as the length of the footwear closure edges and the amount of tensioning control desired.

The cable 22 may be one continuous piece of material that forms a loop that begins and terminates at the tightening mechanism 24, and is threaded through the cable guide members 26*a* and the cross guide members 31 as discussed above. In addition, the cable 22 may be a low-friction cable that slides easily through the channels in the cable guide members and the cross guides, as described above.

Figure 4B:
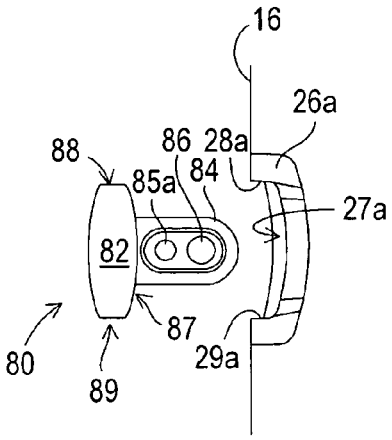
FIGS. 4B and 4C illustrate an implementation of a stop device according to the invention for use in an upper zone of the boot shown in FIG. 4A.
Figure 4C:
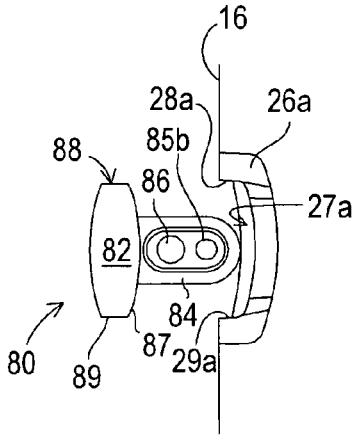

FIGS. 4B and 4C illustrate the relationship of a stop device 80 to a cable guide 26*a* associated with the boot edge 16 in the upper zone 13 shown in FIG. 4A. The stop device 80 includes a stop head 82, a tab 84 and a T-nut 86 which is used to fasten the stop device to the tongue 18. One of skill in the art would recognize that other fastening devices could also be used. In this implementation, the stop device surface 87 is shaped to complement the shape of the inner wall 27*a* of the cable guide member 26*a*. In particular, the stop device surface 87 is curved to match the curvature of the inner wall 27*a* of the generally "C"-shaped cable guide element 26*a*. In addition, the stop head 82 includes generally flat or straight top and bottom edges 88 and 89, which fit securely during use into the inner walls 28*a* and 29*a* of the cable guide element 26*a*. Thus, during use the stop head 82 mates with the cable guide 26*a*. The tab 84 includes two adjustment holes 85*a* and 85*b*, but more or less holes could be used. In this implementation, a user adjusts the placement of the stop device 80 by using a T-nut in either hole 85*a* or 85*b*. In the implementation shown in FIG. 4A, a pair of stop devices 80 are shown positioned to contact the closure edges on opposite sides of the tongue area of the footwear. If the user wishes a larger distance between the side edges in the upper zone, then she would place the T-nut through openings 25*a* as shown in FIG. 4C for each of the stop devices 80. Alternately, if she would rather have the side edges closer together then she would use holes 85*b* as shown in FIG. 4B for each of the stop devices 80. Any combination of adjustment holes could be used.

Figure 4D:
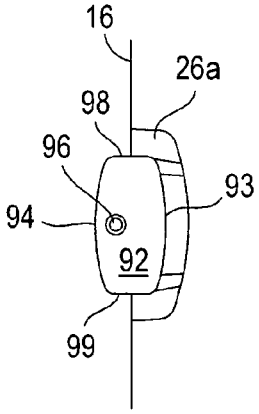
FIGS. 4D to 4F illustrate another implementation of stop device according to the invention for use in a lower zone of the boot shown in FIG. 4A.
Figure 4E:
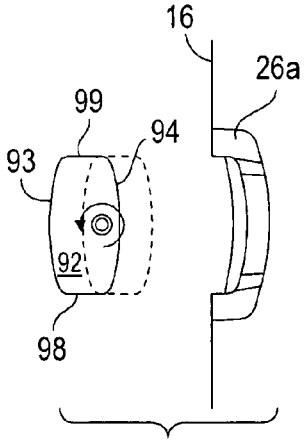
Figure 4F:
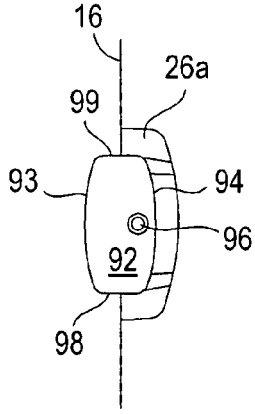

FIGS. 4D to 4F illustrate another implementation of a stop device 90, which is shown in FIG. 4A releasably attached in the lower zone 12. The stop device 90 includes a stop head 92 having a front surface 93, a rear surface 94, a top surface 98 and a bottom surface 99. In FIG. 4D the front surface 93 is contacting the inner wall 27*a* (shown in FIG. 4B) of the cable guide member 26*a*, and the top 98 and bottom 99 surfaces are contacting the inner walls 28*a* and 29*a* of the cable guide element 26*a*. In FIG. 4E, the closure edge 16 is pulled away from the stop device 90, and the stop head 92 has been rotated about a pivot point 96. The pivot point is offset from the center axis of the stop head, and may include a T-nut fastener that affixes the stop element 90 to the tongue 18. When the stop device 90 is disengaged from the cable guide element 26*a* as shown in FIG. 4E, it can be rotated about the pivot point 96 as shown by the circular arrow 91 into another position so that the rear surface 94 is now facing the closure element 26*a* and the bottom surface 99 has switched positions with the top surface 98. The rear surface 94 of the stop head 92 then may contact the cable guide element 26*a* as shown in FIG. 4F. Since the pivot point 96 is offset from the central axis of the stop head, the user can adjust the relative distance between the stop head and the closure edge 16. In the implementation shown in FIG. 4A, a pair of stop devices 90 are shown positioned to contact the closure edges in a lower zone 12 on opposite sides of the tongue area of the footwear. A user can adjust the distance between the side portions 14 and 16 of the boot by rotating one or both of the stop devices 90.

Referring again to FIG. 4A, the stop devices 80 and 90 are shown in the relaxed position, wherein a user may insert her foot into the boot 10. In the stop position, the front edge 87 of the upper zone stop heads 82 abut an outside all of the cable guide members 26*a*, and one of the front edges 93 or the rear edge 94 of the stop devices 90 abut an outside all of the cable guide members 26*a* in the lower zone 12. The stop deices 80 and 90 thus function to resist movement of the closure edges 14 and 16 toward each other. It should also be noted that FIG. 4A shows one pair of upper zone and one pair of lower zone stop devices (four in all), but additional pairs could be used, and the stop devices could be used in different combinations.

When first putting the boot on the foot, a user may adjust either the first zone 13 about the upper cuff of the lacing system 20*a*, or the second zone 12 about the lower cuff of the lacing system. Users that have a skinny or thin foot would adjust the first zone before making other adjustments to ensure that the upper cuff is not too tight. Alternately, wearers that have relatively wide feet and skinny calves initially adjust the second zone to secure the stop devices 90 so that the lower cuff is not too tight. When the entire boot feels comfortable, the user tightens the T-nuts on the stop devices 80 in the upper zone (see FIGS. 4B and 4C), and no longer rotates the stop devices 90 in the lower zone 12 (shown in FIGS. 4D to 4F). The tightening mechanism 24 then can be further manipulated to tighten the third zone 15 adjacent to the instep portion of the boot.

The stop guide devices shown in FIGS. 2A to 2C, 3A to 3C and 4B to 4F may advantageously be made of a light and durable rigid or semi-rigid material. For example, the stop guide and stop head may be made of plastic, rubber, metal or a composite material that is able to withstand tension forces associated with tensioning the laces to secure the footwear to the foot, and forces that may occur while a wearer uses the footwear to maneuver down a slope. In addition, the stop head may be shaped to complement the shape of a cable guide member that is affixed to a closure edge, or may be of some other shape.

Figure 5A:
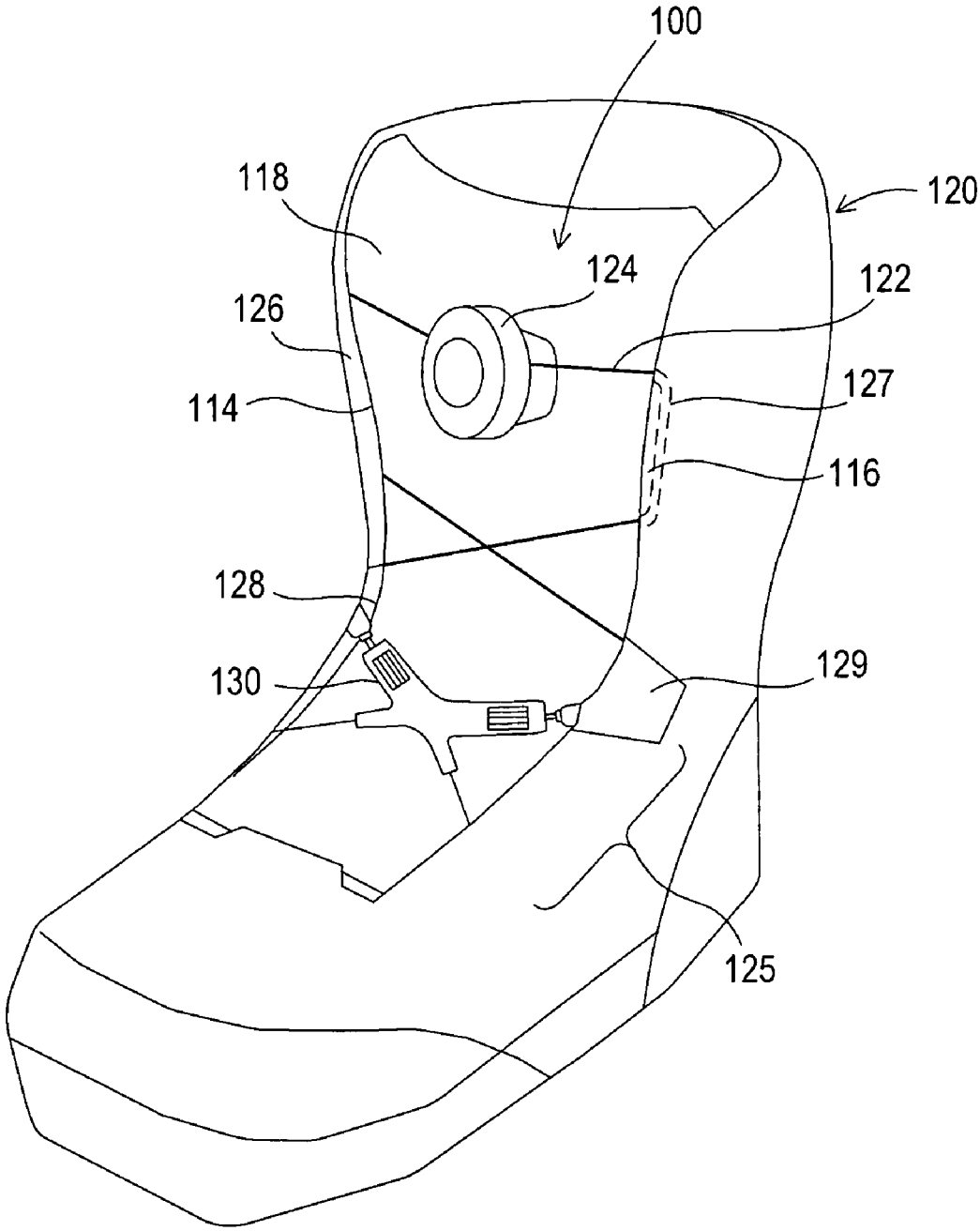
FIG. 5A illustrates an alternate embodiment of a lace tension system using a cable lock-out device according to the invention for a sports boot.

FIG. 5A illustrates an alternate embodiment of a lace tension system 100 for a sports boot 120. The boot upper includes two opposed closure edges 114 and 116 that partially cover a tongue 118.

The lacing system 100 includes a cable 122, tightening mechanism 124, opposing cable guide members 126, 127 (shown as dotted lines because these cable guide members are embedded in the upper) and cable guide members 128, 129, and a cable lock-out device 130. The cable 122 is threaded in a crossing pattern along the midline of the boot over the tongue 118 between the two generally parallel closure edges 114 and 116. The cable guide members 126, 127 and 128,129*a* and the cable lock-out device 130 include channels or passageways therethrough for accommodating the cable 122, and can be made of a rigid or durable plastics rubber or composite material. Although not shown, one or more cable guide members may also be present along the toe area of the boot. The cable guide members are affixed to the closure edges 114 and 116 in a known manner. The cable 122 may be one continuous loop that begins and terminates at the tightening mechanism 124. The cable guide members and cable may be made of the materials described above.

Figure 5B:
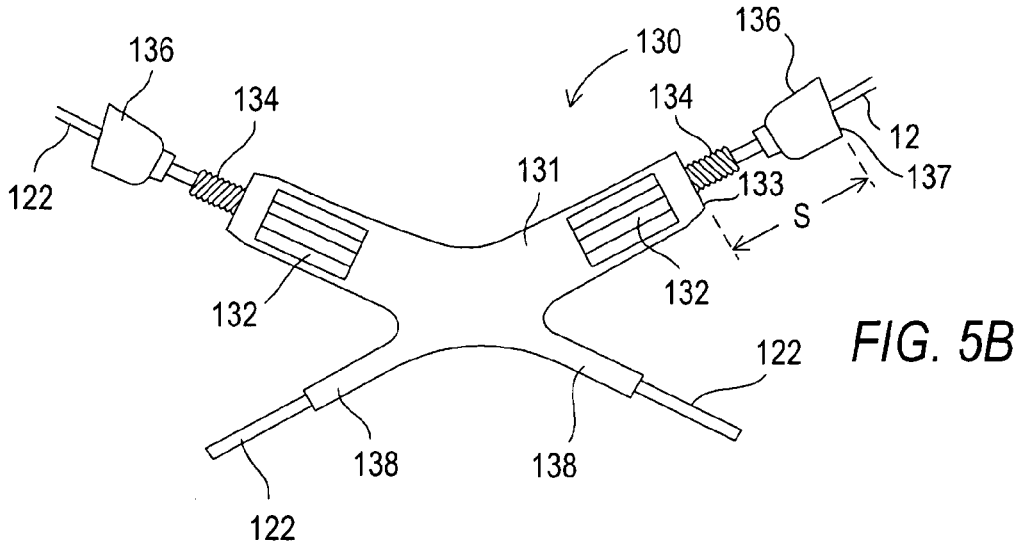
FIG. 5B is an enlarged front view of the cable lock-out device shown in FIG. 5A.

FIG. 5B is an enlarged front view of the cable lock-out device 130 shown in FIG. 5A. The cable lock-out device includes a base 131, twist-tightening mechanisms 132, threaded tubes 134, stop bumpers 136 and channel guides 138.

Referring again to FIG. 5A, the cable lock-out device accommodates the cable 122 at a cross-over position over a forefoot zone 125. The cable passes freely through channels located in the body 131, channel guides 138, threaded tubes 134 and stop bumpers 136. A wearer adjusts the lock-out device 130 to assume a lock-out position by twisting the twist tightening mechanism 132 to adjust the length "S" (see FIG. 5B) between the body edge 133 and stop bumper edge 137. The edge 137 of the stop bumper 136 contacts a surface of the cable guide members 128 and/or 129 to prevent the closure edges 114 and/or 116 from advancing towards each other while the boot 120 is being tightened or when the boot is in use during an athletic activity, for example. A user can turn the twist tightening mechanism 132 to elongate or shorten the threaded tube 134 which increases or decreases the length "S" to vary the lock-out distances between the closure edges 114 and 116. Thus, if the wearer has a relatively wide forefoot, he would increase the length "S" by adjusting one or both of the threaded tubes 134 of the cable lock-out device 130 which is located in the forefoot zone 125 in FIG. 5A. In an implementation, the length "S" on one side of the cable lock-out device can be varied from about 0.5 to 1.5 inches.

It should be understood that the cable lock-out device could be used in other locations as well, such as in the upper cuff zone 123, where the cable 122 crosses over the tongue. In addition, two or more cable lock-out devices could be used on a boot, and/or could be used in conjunction with other types of stop devices such as those described above.

Figure 5C:
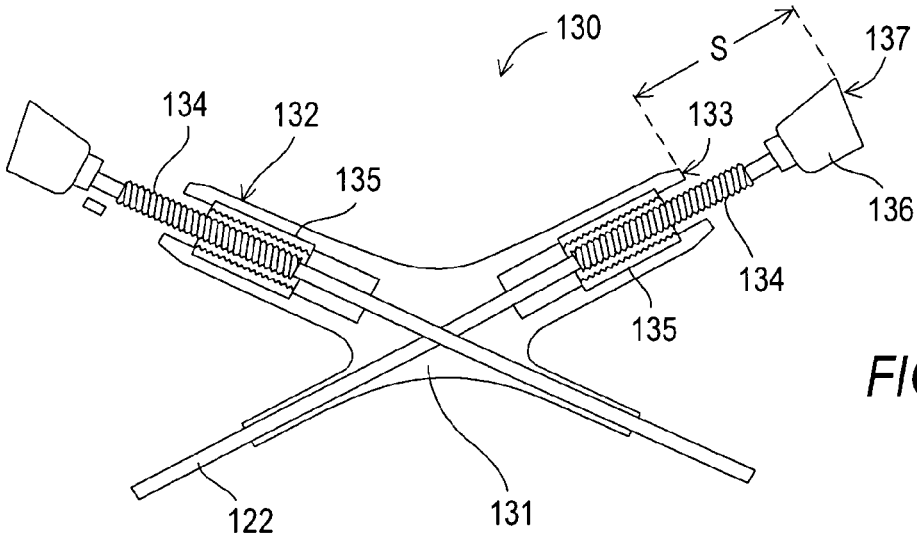
FIG. 5C is a cross-sectional view of the cable lock-out device of FIG. 5B.

FIG. 5C is a cross-sectional view of the cable lock-out device 130 of FIG. 5B. In this implementation, the body 131 is made of molded plastic and includes channels to permit the cable 122 to freely move therethrough. The twist-tightening mechanisms 132 include threaded sleeves 135 that can be twisted or turned by a wearer to either elongate or retract the threaded tubes 134 to vary the length "S" between the stop bumper edges 137 and the body edge 133. Conventionally, the twist-tightening mechanisms are turned in a clockwise manner to extend the threaded tube, and turned in a counter-clockwise manner to retract the threaded tube. The wearer can therefore control the distance between the closure edges 114 and 116 of the boot by adjusting the twist-tightening mechanisms 132.

Figure 5D:
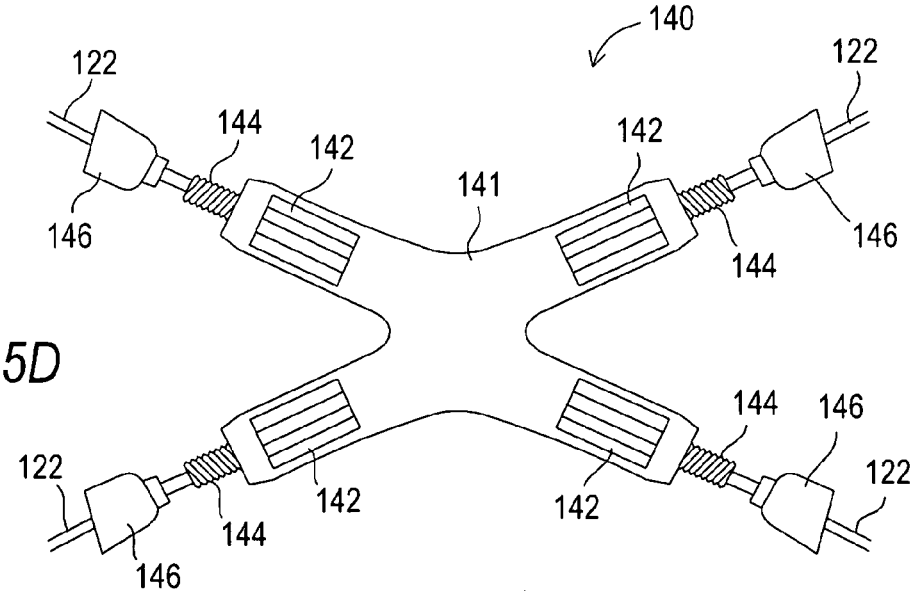
FIG. 5D illustrates an alternate implementation of a cable lock-out device according to the invention.

FIG. 5D illustrates an alternate implementation of a cable lock-out device 140. This implementation includes a body 141, four twist tightening mechanisms 142, four threaded tubes 144 and four stop bumpers 146. The cable 122 moves freely through the channels within the cable lock-out device 140. The lock-out device 140 provides a wearer with more adjustment options than the cable lock-out device 130 with respect to preventing the boot closure edges 114 and 116 in a zone or area from advancing towards each other.

Figure 6:
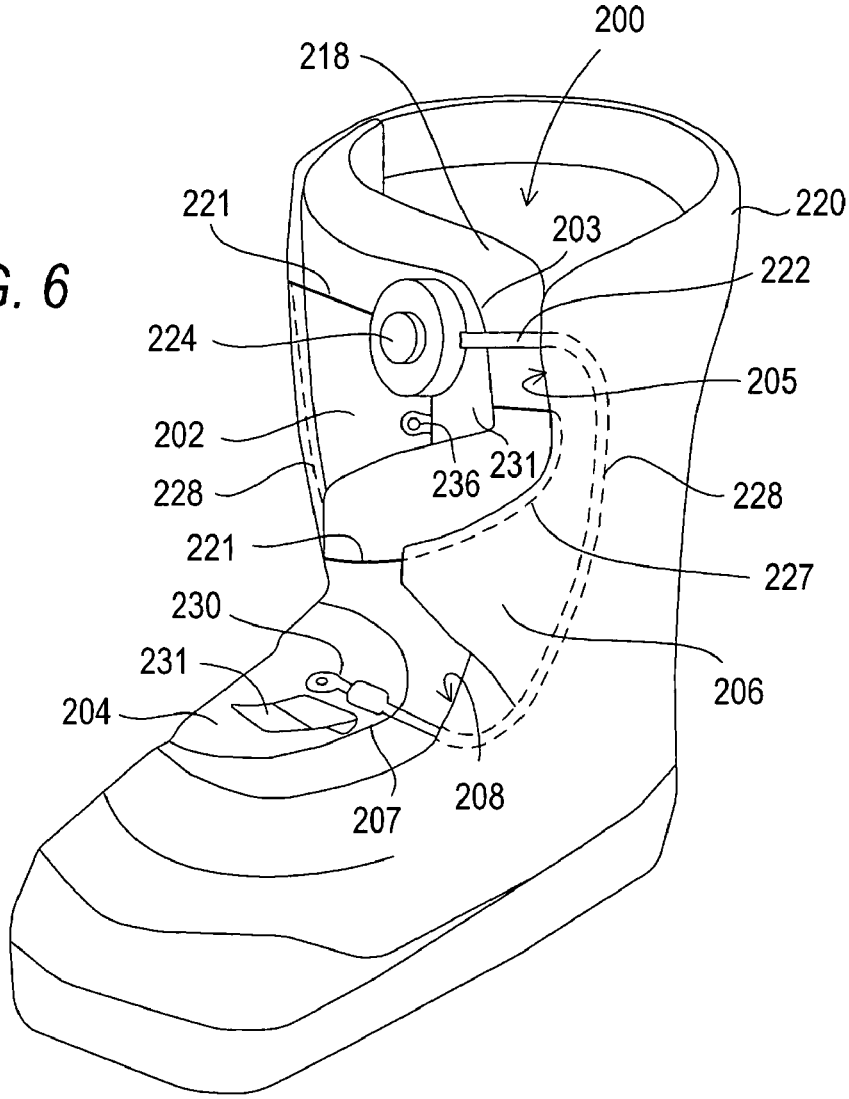
FIG. 6 illustrates vet another alternate embodiment of a lace tension system using cable-end tightening devices according to the invention for a sports boot.

FIG. 6 illustrates yet another alternate embodiment of a lace tension system 200 for a sports boot 220. The sport boot 220 includes an upper lateral flap 202 and a lower lateral flap 204 on a side of the boot opposite an inteniediate medial flap 206 positioned over a tongue 218. A tightening mechanism 224 is affixed to the upper lateral flap 202. A first cable 221 is operable to urge edge 203 of the upper flap 202 towards the edge 205. A second cable 222 is operable to urge edge 207 of the lower flap towards the edge 208. The lace tension system 200 may also include embedded cable guide numbers 226, 227 and 228 shown as dotted lines in FIG. 6, and includes cable-end tightening devices 230.

Figure 7A:
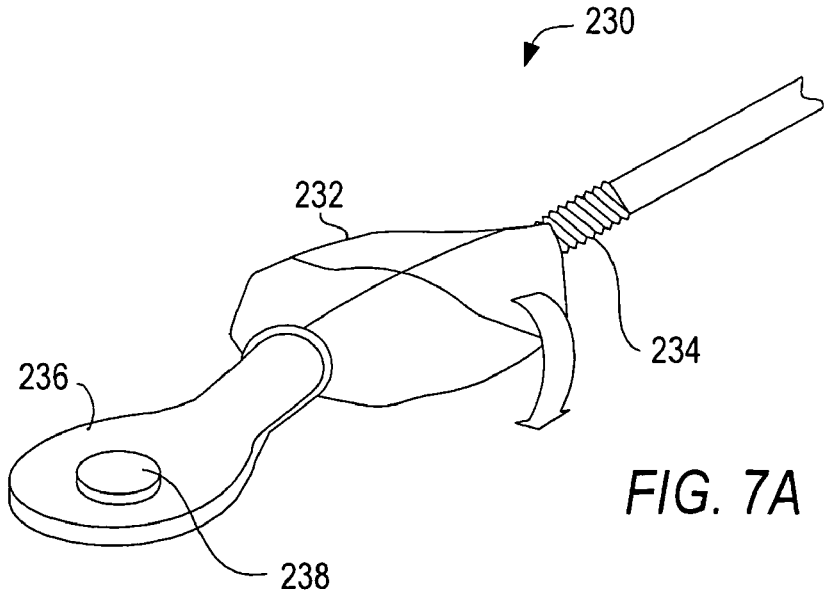
FIG. 7A is a perspective vie of a cable-end tightening device according to the invention.
Figure 7B:
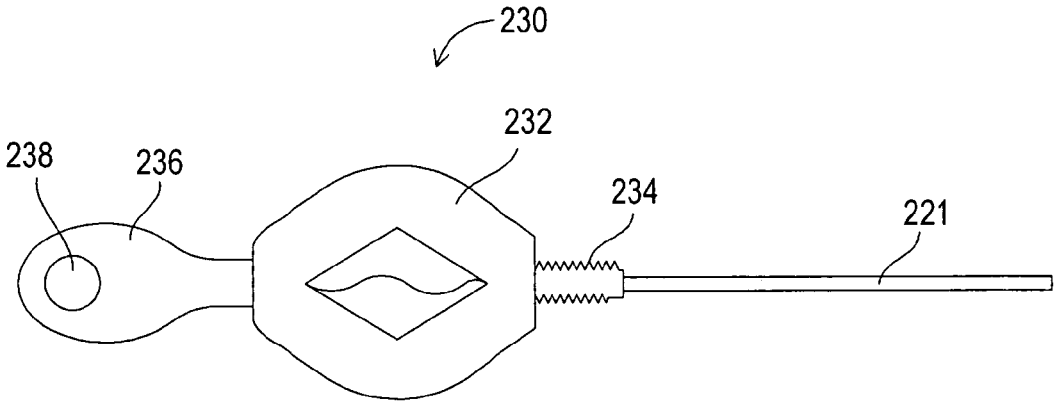
FIG. 7B is an enlarged view of a cable-end tightening device of FIG. 7A according to the invention.
Figure 7C:
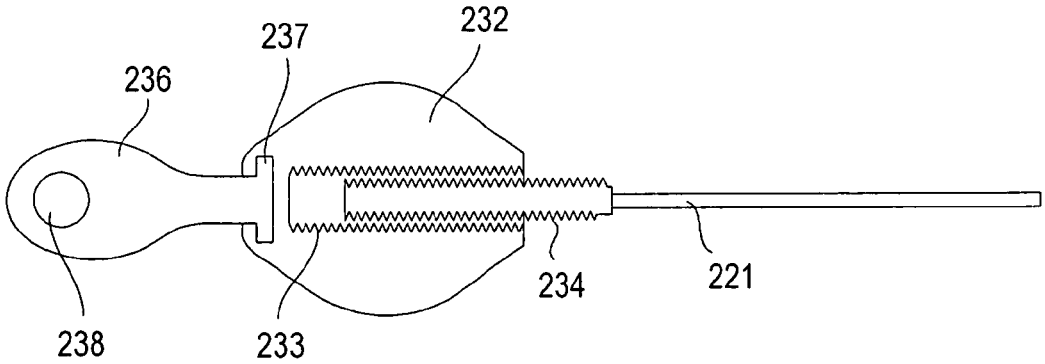
FIG. 7C is an enlarged cross-sectional view of the cable-tightening device of FIGS. 7A and 7B.
Figure 7D:
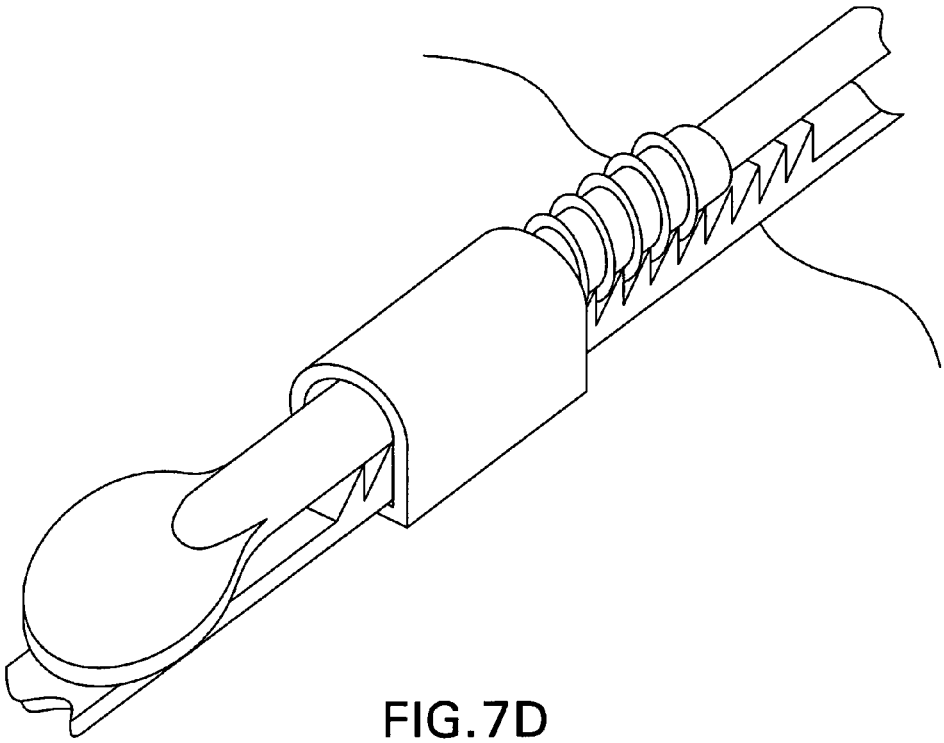
FIG. 7D is a side view of an alternate embodiment of FIG. 7C that includes a ratchet mechanism.

FIG. 7A is an enlarged, perspective view of cable-end tightening device 230. The cable-end tightening device 230 includes a twist-tightening mechanism 232, threaded member 234 and end section 236. The end section 236 includes an aperture 238 for accommodating a rivet, screw or other fastener to affix the cable-end tightening device 230 to the boot. FIG. 7B is an enlarged, top view of the cable-end device 230 of FIG. 7A. FIG. 7C is an enlarged cross-sectional view of the cable-end tightener 230 of FIGS. 7A and/or 7B. The threaded member 234 is connected to an end of cable 221 or 222 and meshes with teeth 233 of the twist-tightening mechanism 232. The end section 236 includes a free-spinning connector portion 237. Thus, when in use, a wearer turns or twists the mechanism 232 in a first direction to either pull cable 222 towards the end section 236 to tighten the cable system, or turns the mechanism in a second, opposite direction to extend the cable to loosen the cable system. Typically, the mechanism 232 is turned in a clockwise manner to tighten the cable, and turned counter-clockwise to loosen the cable. In an implementation, the threaded member 234 and teeth section 233 are about one-inch long to permit about one-inch of cable length adjustment. As an alternative embodiment, FIG. 7D illustrates an embodiment that includes a ratchet mechanism for tightening the cable.

Referring again to FIG. 6, the tightening mechanism 224 is configured to be used to separately tighten or loosen the upper flap 202 and lower flap 204 by reeling in or letting out the first cable 221 and/or second cable 222. Thus, the lace tension system 200 utilizes two separate cables to provide adjustment capability for two different zones. In addition, FIG. 6 shows protective flaps 231 which can be used to cover the cable-end tightening mechanism 230.

Figure 8:
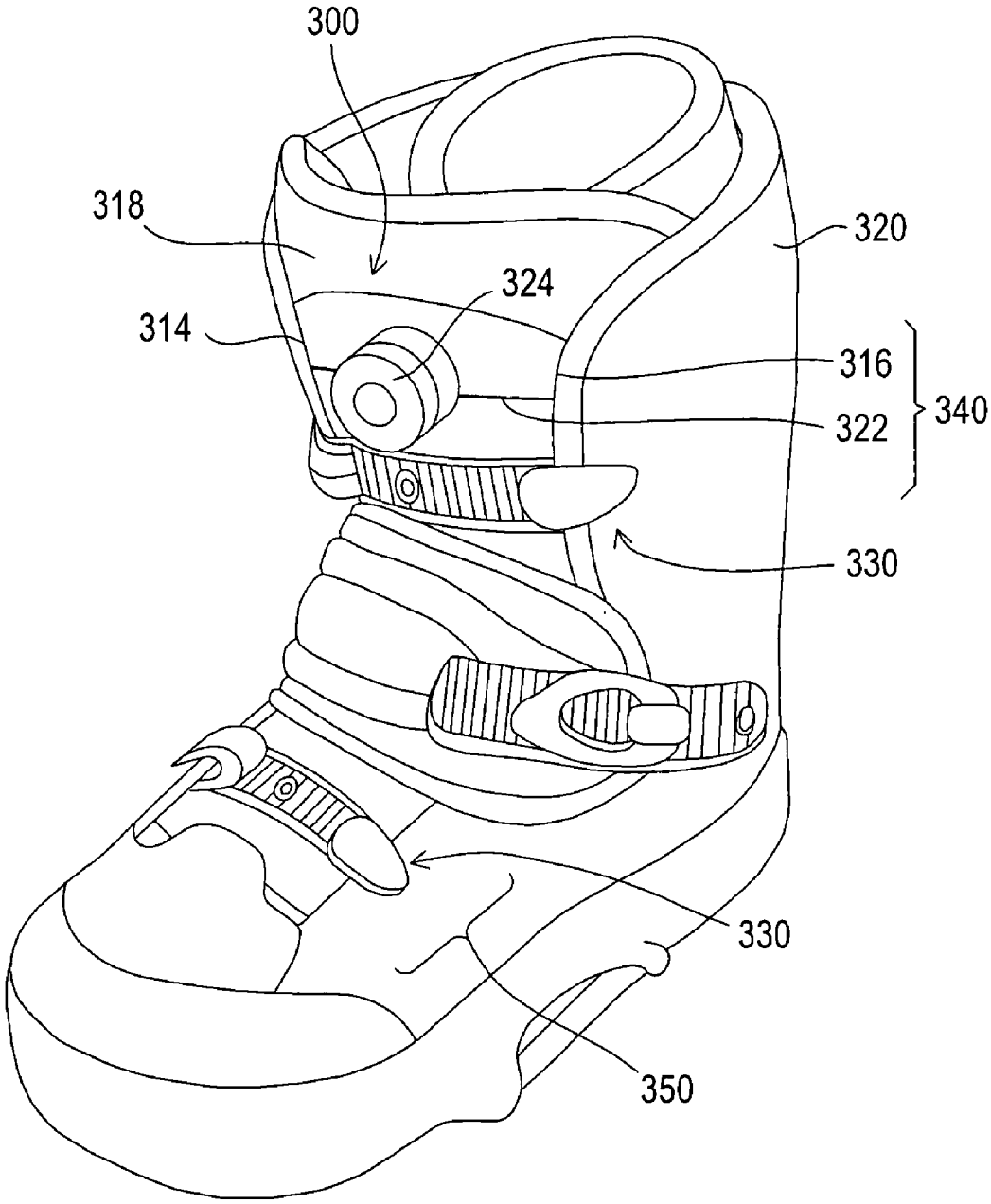
FIG. 8 illustrates yet another variation of a lace tension system using fit adjustment elements according to the invention for a sports boot.

FIG. 8 illustrates yet another variation of a lace tension system 300 for a sports boot 320. The boot upper includes two opposed closure edges 314 and 316 that partially cover a tongue 318. The lacing system 300 includes a cable 322, tightening mechanism 324, and cable guide members (not shown, but the cable guide members may be embedded within the boot upper and include channels to permit the cable to slide freely therethrough). Also included are fit adjustment elements 330 which can be positioned between opposing cable guide members. The fit adjustment elements 330 do not require any tools in order to be adjusted, have tracks 334 shown affixed to the tongue 318, and operate to prevent the closure edges 314 and 316 from advancing toward each other.

Figure 9A:
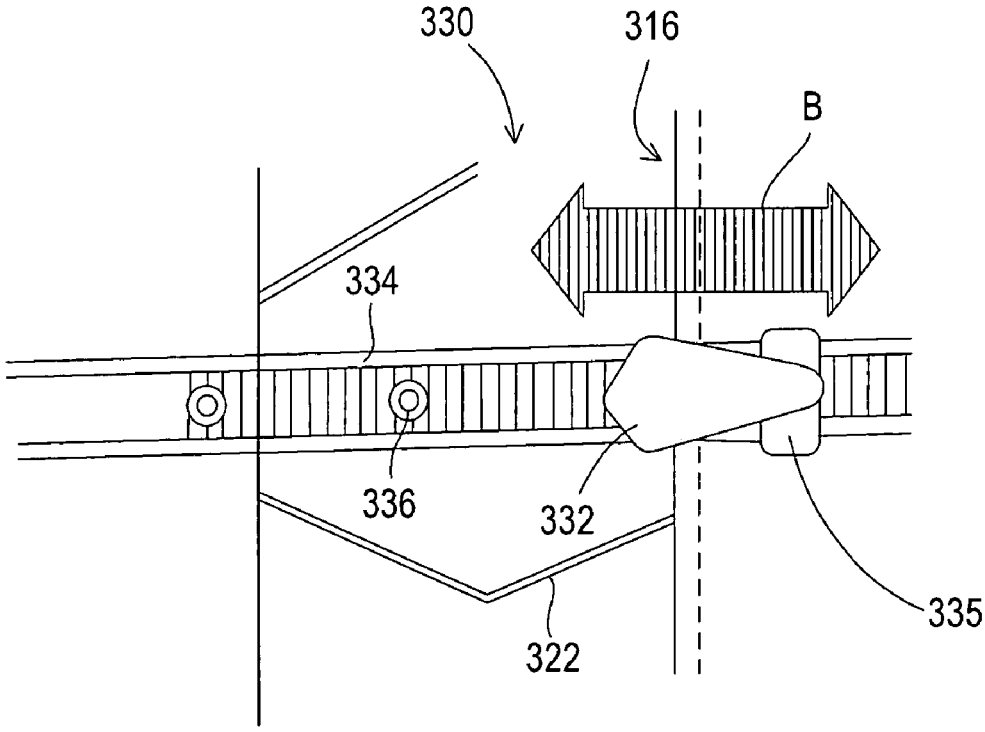
FIG. 9A is an enlarged front view of the fit adjustment element of FIG. 8.

FIG. 9A is an enlarged top or front view of a fit adjustment element 330 of FIG. 8. The fit adjustment element includes a stop hook 332, a toothed track 334 and at least one fastener 336 to affix the track to the tongue 318. The stop hook 332 can be adjusted along the length of the track 334 by a wearer as shown by arrow "B" so that it to engages the closure edge 316 when in use. A rivet 336 or other fastener may function to limit the travel of the stop hook 332 so that it cannot be moved past the mid-line of the tongue, for example.

Figure 9B:
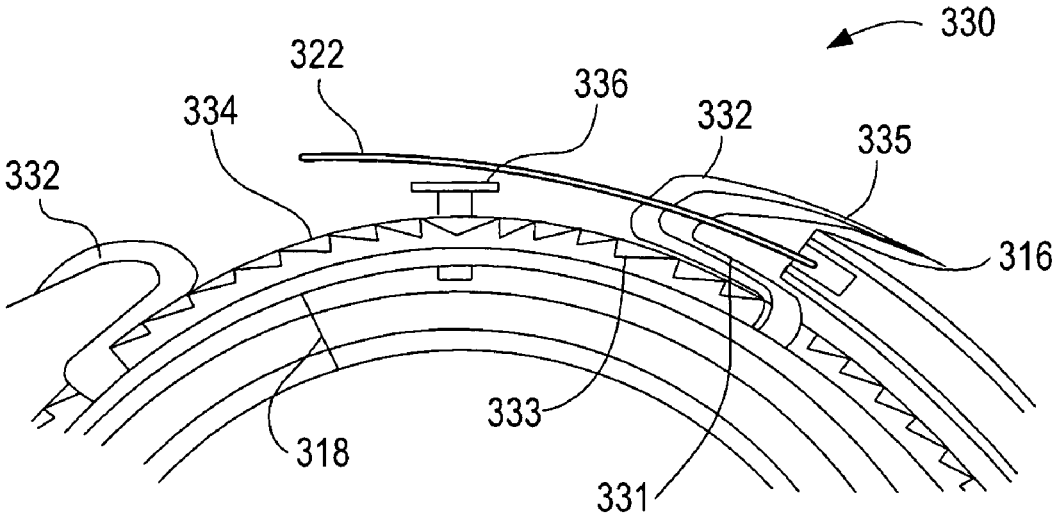
FIG. 9B is a cross-sectional top vie of the fit adjustment element of FIG. 9A attached to the tongue of the sports shoe by a rivet.

FIG. 9B is a cross-sectional side view of a fit adjustment element 330. As shown, the toothed track 334 is attached to a tongue 318 by a rivet 336. In this implementation, the stop hook 332 include at least one tooth 333 on each of a pair of flexible arms 331 that can be positioned to engage with the teeth of the toothed track 334. The arms 331 of the stop hook 332 connect under the toothed track 334 to create a pivot mechanism. A user presses downward on the rear handle portion 335 to cause a pivoting action that disengages the teeth 333 from the toothed track 334 and lifts the stop hook 332 to reposition it by sliding the stop hook along the toothed track 334. Once a desired position is reached the user presses the stop hook towards the toothed track so that the teeth 333 will engage therewith. When the stop hook 332 is engaged, it prevents the closure edge 316 from moving toward the opposite closure edge 314 (see FIG. 8). As the wearer reels in the cable 322 to tighten the boot about the foot, the closure edges contact the stop hooks 332 which then securely engage with the toothed track.

Referring again to FIG. 8, two pairs of fit adjustment elements 330 are shown, one to regulate the fit about an upper cuff area 340 and another to regulate the fit about a forefoot area 350. But one skilled in the art would recognize that other configurations, which may utilize more or less adjustment fit elements, could be used to provide fit adjustment options for a wearer.

Figure 10:
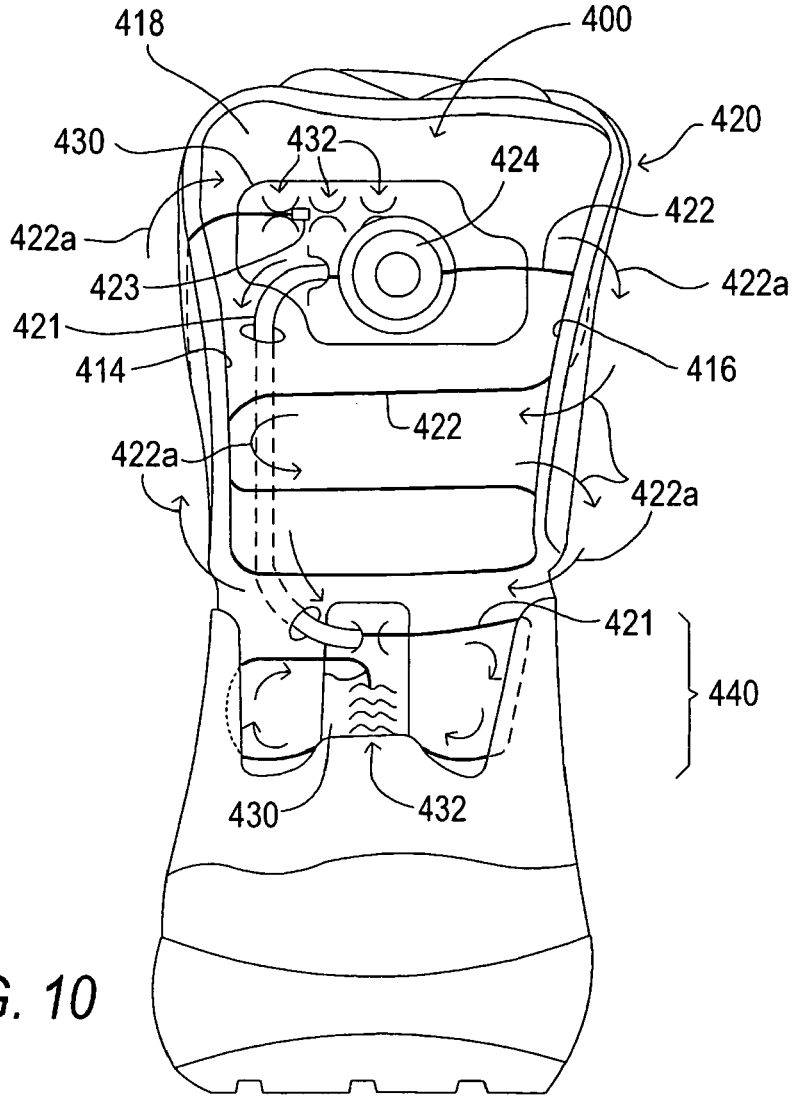
FIG. 10 is a front view of another embodiment of a lace tension system using cable length adjustment devices according to the invention for a sports boot.
Figure 10A:
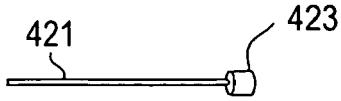
FIG. 10A is an enlarged side view of a cable and end cap for use with the cable length adjustment devices of FIG. 10.

FIG. 10 is another embodiment of a lace tension system 400 for a sports boot 420. The boot 420 includes two opposed closure edges 414 and 416 that cover the edges of a tongue 418. The lacing system includes cables 421 and 422, a tightening, mechanism 424 and cable guide members (not shown, but the cable guide member may be embedded within the boot upper and include channels to permit the cable to slide freely therethrough). Also included are cable length adjustment devices 430 that are affixed to the tongue 418 by known methods, such as by stitching or by adhesive means. The adjustment devices 430 include a plurality of end stations 432 that are configured to mate with an end cap 423 of the cables 421 and 422. FIG. 10A is an enlarged drawing illustrating a cable 421 having an end cap 423. In the implementation of FIG. 10, the tightening mechanism 424 is operable to tighten or loosen the first cable 421 and the second cable 422. The first cable 421 operates to adjust the fit of a lower portion 440, and the cable 421 is routed straight downward through the tongue 418 so that flexing of the ankle of a wearer during use does not affect the fit of the lower boot. The second cable 422 is operable to adjust the fit of an upper portion of 450 of the boot. This cable 422 follows a serpentine path as shown by arrows 422*a* and terminates at an end station 432 adjacent the tightening mechanism 424. A wearer utilizes the end station 432 of the adjustment device 430 to adjust the length of one or both cables 421 and 422.

Figure 11:
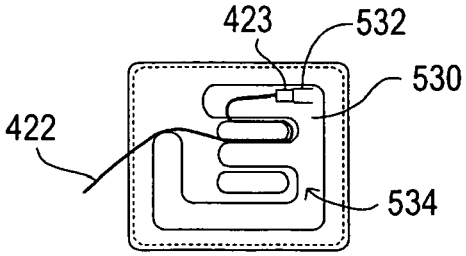
FIG. 11 shows an alternative embodiment of a cable length adjustment device that may be used in the lace tension system of FIG. 10.

FIG. 11 shows an alternative embodiment of a cable length adjustment device 530. The adjustment device includes one end station 532 for accommodating an end cap 423 (see FIG. 10A) of a cable 422, and a serpentine path 534 for use in adjusting the cable length. As shown, only a portion of the serpentine path 534 has been used in FIG. 11. Thus, the length of the cable can be varied depending on whether some, none or all of the serpentine path is used. The cable length adjustment device 530 may be made of molded plastic, rubber or a durable composite material, and may be stitched or otherwise attached to the tongue or other portion of an article of footwear.

It should be noted that the lace tension systems shown in FIGS. 6 and 10 utilize two separate cables to separately adjust two zones on an article of footwear, whereas the systems of FIGS. 1, 4 and 8 may utilize one continuous cable but are operable for adjustment of multiple zones. One of skill in the art would recognize that other configurations are possible that could use one, two or more cables for adjustment of one or more zones.

The tightening mechanism in the implementations shown in the figures generally includes a circular housing and a circular knob rotatably mounted thereon. The knob may be rotated in a clockwise manner to wind the ends of the lace into the housing onto a spool or spools to thereby tension the lace and to reduce the slack in the lacing system. The tightening mechanism may include an internal gearing mechanism that allows a wearer to manually turn the knob to retract the lace. The internal mechanism may also be configured to permit incremental winding to retain predetermined amounts of lace as the knob is turned, and may include a ratchet mechanism or other arrangement to resist unwinding of the spool. The knob may be turned manually by a wearer, or a small motor may be included to provide turning power. In order to loosen the laces, a release lever may be provided to disengage the spool from the internal gearing mechanism to unravel the lace so that the closure edges can be separated and the wearer can remove her foot from the boot.

The footwear lacing systems described herein advantageously allow users to adjust the boot closure edge to closure edge distance of one or more zones to obtain a customized fit. The low friction cable along with the low friction cable guides and/or cross guide members allow for easy sliding of the cable within the guides. Use of low friction materials on the surface of the tongue also facilitates movement of the closure edges as the cable is tightened.

Although particular implementations have been described, it should be understood that one of skill in the art could make many changes or modifications that would fall within the scope of the invention. For example, the various type of stop devices, cable guide members, cross guide members, cable lock-out devices, cable-end tightening devices and other described devices could be used with one another in various combinations, and could be used with one or more cables to provide a lace tension system.

What is claimed is:

1. A footwear lacing system for an article of footwear that includes a tongue area and first and second opposing closure edges comprising:

at least one lace having an end that is provided with threads;

a lace guiding system having a plurality of lace guides affixed to the first and second closure edges for guiding the lace to traverse the tongue area in a plurality of locations to enable tightening of the footwear on the foot of a wearer; and at least one lace end tightening device affixed to the footwear for accommodating an end portion of the lace to provide for adjustments to the tension of the lace; the tightening device comprising a twist-tightening mechanism for engagement by the user; a threaded member associated the mechanism configured for mating threaded engagement with the end of the lace that has the threads; a structure associated with the threaded member for resisting rotation when not desired; and an end section for mounting to the footwear article;

wherein rotation of the twist-tightening device tightens or loosens the lace to facilitate adapting of the article of footwear to the user's foot.

2. The lacing system of claim 1, wherein the structure comprises flattened side portions associated with the twist-tightening mechanism so that the mechanism does not rotate after the user tensions the lace.

3. The lacing system of claim 2, further comprising a protective flap for covering the threaded member of the cable-end tightening mechanism.

4. The lacing system of claim 1, wherein the lace end tightening device end section is freely rotatable with respect to the twist tightening mechanism threaded member.

5. The lacing system of claim 1 further comprising a plurality of lace end tightening devices so that a plurality of end stations are present, each capable of releasable connection to the lace.

6. The lacing system of claim 5 wherein the lace is provided along a serpentine path.

7. The lacing system of claim 5, wherein a lace is associated with each tightening mechanism.

8. The lacing system of claim 7, wherein each lace is present in a different portion of the article of footwear so that adjustment capability is provided for two different zones of the footwear.

9. The lacing system of claim 8, wherein one zone is near an ankle region of the footwear article and the other is near the foot region.

10. The lacing system of claim 9, wherein each zone is associated with the tongue of the article of footwear, with one zone being associated with a top portion of the tongue and the other being associated with a bottom portion of the tongue.

11. The lacing system of claim 1 which further comprises two crossing lace channels and at least two adjustable stop bumpers, the stop bumpers configured to contact first and a second opposing closure edges of the footwear article, wherein the tightening mechanism is associated with each of the stop bumpers.

12. The lacing system of claim 11, further comprising four adjustable stop bumpers, the stop bumpers configured to contact first and a second opposing closure edges of the footwear article.

13. The lacing system of claim 1 wherein the structure includes teeth.

14. The lacing system of claim 13 which further comprises an element having an affixing member that includes at least one tooth for releasably meshing with the teeth of the structure to prevent rotational movement.

* * * * *